US006508308B1

(12) United States Patent
Shaw

(10) Patent No.: US 6,508,308 B1
(45) Date of Patent: Jan. 21, 2003

(54) PROGRESSIVE PRODUCTION METHODS AND SYSTEM

(75) Inventor: Christopher Kempson Shaw, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 70 days.

(21) Appl. No.: 09/669,385

(22) Filed: Sep. 26, 2000

(51) Int. Cl.[7] ..... E21B 43/00; E21B 43/12

(52) U.S. Cl. ..... 166/313; 166/68.5; 166/105; 166/242.3; 166/369; 166/375; 166/384; 417/423.3; 417/426

(58) Field of Search ..... 166/66.4, 68.5, 166/105, 242.3, 313, 319, 332.1, 369, 370, 375, 384; 417/423.3, 423.5, 424.2, 426

(56) References Cited

U.S. PATENT DOCUMENTS 2,720,926 A * 10/1955 Brown ..... 166/115
3,739,850 A * 6/1973 Sizer ..... 166/313
3,741,298 A 6/1973 Canton
5,447,416 A 9/1995 Wittrisch
5,862,863 A * 1/1999 Swisher ..... 166/313
5,975,209 A 11/1999 McCorry
6,079,494 A * 6/2000 Longbottom et al. .... 166/117.5
6,089,832 A * 7/2000 Patterson ..... 166/68.5
6,092,600 A * 7/2000 McKinzie et al. ..... 166/106
6,119,780 A * 9/2000 Christmas ..... 166/105
6,168,388 B1 * 1/2001 Hughes et al. ..... 166/105
6,220,358 B1 * 4/2001 Leniek, Sr. ..... 166/369
6,250,390 B1 * 6/2001 Narvaez et al. ..... 166/369
6,260,627 B1 * 7/2001 Rivas ..... 166/369
6,298,917 B1 * 10/2001 Kobylinski et al. ..... 166/105

OTHER PUBLICATIONS

The American Heritage Dictionary, Second College Edition, 1982, Houghton Mifflin Company, p. 465.*

* cited by examiner

*Primary Examiner*—George Suchfield
(74) *Attorney, Agent, or Firm*—Bracewell & Patterson, L.L.P.

(57) ABSTRACT

Methods for staged production from a wellbore include pumps sequentially operated during the life of the well. In described embodiments, production assemblies are used for progressive staged production process in which the production tubing is bifurcated to provide a pair of legs. One of the legs includes a first pump that may be selectively actuated to flow fluid through one of the legs. Means are also provided, including a sliding sleeve and a flapper valve diverter, for blocking production fluid flow through one leg or the other. A second fluid pump is lowered inside of the production tubing to pump fluid after the first pump has failed.

14 Claims, 7 Drawing Sheets

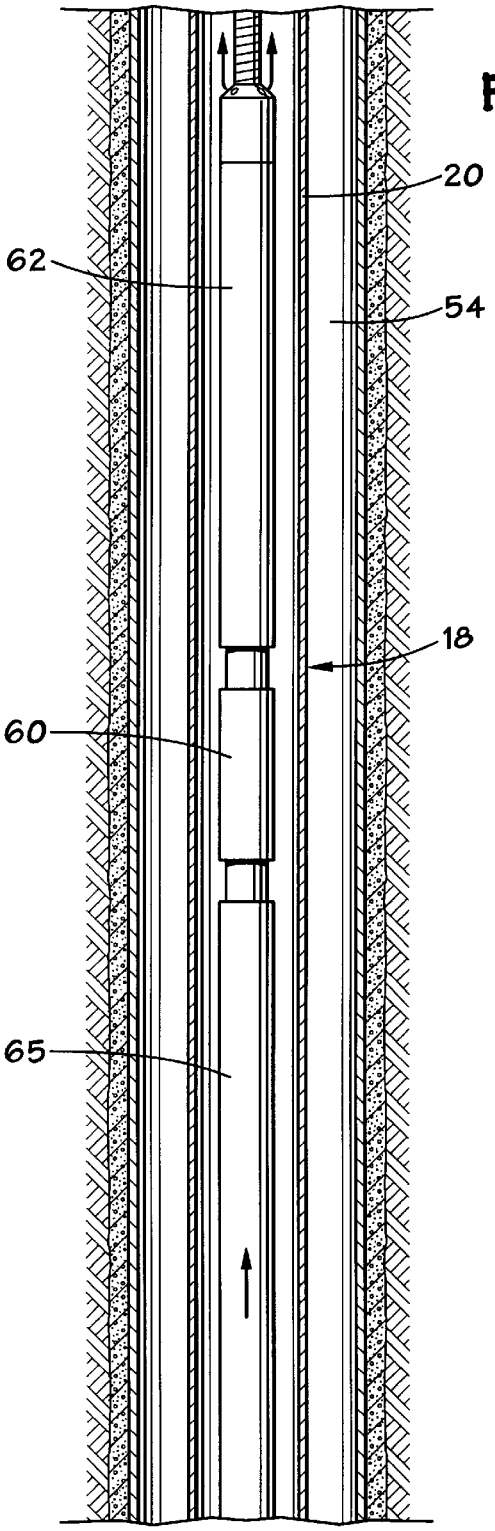
FIG. 2B
FIG. 2C
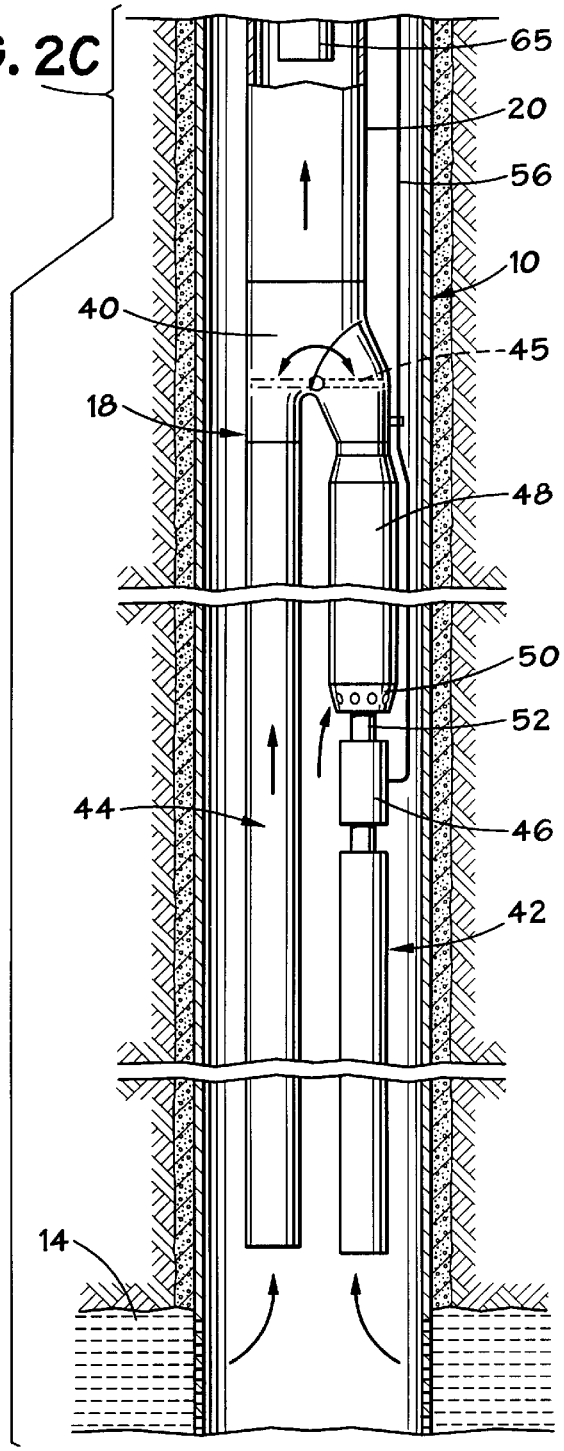

20
56
40'
18'
13
48
70
50
70A
52
44
46
42
14

64
20
56
10
40'
18''
13
48
50
52
46
44
42
84
90
88
80
82
90A
14
86

102
112
120
64
13
116
114
118
118
100
104
110
110
106
108
14

PROGRESSIVE PRODUCTION METHODS AND SYSTEM

BACKGROUND OF THE INVENTION

1. Field of the Invention

This invention relates in general to oil well electrical submersible pumps. In particular aspects, the invention relates to the use of coiled tubing-disposed pumps for continuing production after a production tubing-disposed pump has failed.

2. Related Art

Electrical submersible pumps ("ESPs") are commonly used in oil and gas wells for producing large volumes of well fluid after natural production has decreased in flow. In conventional methods of production, an ESP would be installed by incorporating it within a string of production tubing or conventional threaded pipe and then lowering the ESP assembly into the well. This process employs the use of a rig and is time consuming. A few ESPs have been installed on coiled tubing for pumping up the annulus surrounding the coiled tubing. Coiled tubing is deployed by a coiled tubing injector from a large reel. There is no need for a rig, and the running time is generally less than for an ESP installed on production tubing. However, because standard wellheads are not designed to receive coiled tubing without first removing the production string, these systems provide no real advantages over traditional systems.

Unfortunately, most ESPs only have a 2 to 3 year life. Thus, at some point in time, a new ESP is needed to continue producing the well. The conventional method to deploy the new ESP is to use a workover rig to remove the production string from the well and replace the worn-out ESP that is incorporated in the string with a new one. The process of removal and replacement costs the well operator both time and money, particularly for offshore subsea wells. Proposals have been made to use a Y-tool with one leg supporting a main ESP and the other a back-up ESP. Improvements to the methods and systems of the prior art are desirable.

SUMMARY OF THE INVENTION

This invention provides systems and methods for staged production from a wellbore. In exemplary embodiments described herein, there may be three progressive stages to the production process. The first stage may be natural production, which uses natural formation pressures to bring the production fluid to the surface. The second stage of production is through the use of a first fluid pump, which may be installed at the time of original well completion on conventional threaded pipe. The third stage is the deployment and use of a second fluid pump on coiled tubing within the production tubing for additional production.

Exemplary production systems are described that allow a well to be progressively produced without the need to remove production tubing from the wellbore. The exemplary systems include a Y-tool with two legs. The Y-tool is suspended at the lower end of a string of production tubing. One of the legs supports a first fluid pump. In one preferred embodiment, there is a diverter assembly incorporated into the Y-tool for selectively isolating flow through either of the legs thereby allowing selective use of the first fluid pump. In an alternative embodiment, a sliding sleeve arrangement provides selective flow through the first fluid pump.

At the point where natural pressure or flow decreases in the reservoir, the first, production tubing-based pump is turned on and operated to failure. Upon failure of the production tubing-based pump, a second fluid pump is run into the production tubing on coiled tubing. Additionally production fluid to the surface is flowed using the second pump, thereby eliminating the need to remove the production tubing from the wellbore and then replace the first fluid pump. Upon failure of the coiled tubing-based pump, that pump may be easily removed from the wellbore and replaced without the cost and time associated with removal of the production tubing from the wellbore.

BRIEF DESCRIPTION OF DRAWINGS

FIGS. 2A, 2B and 2C are side cross-sectional views of the wellbore shown in FIGS. 1A and 1B, shown in a vertical cross-section 90° from FIG. 1A and illustrating the deployment and use of a second ESP on coiled tubing within the first ESPs casing.

BEST MODES FOR CARRYING OUT THE INVENTION

Figure 1A:
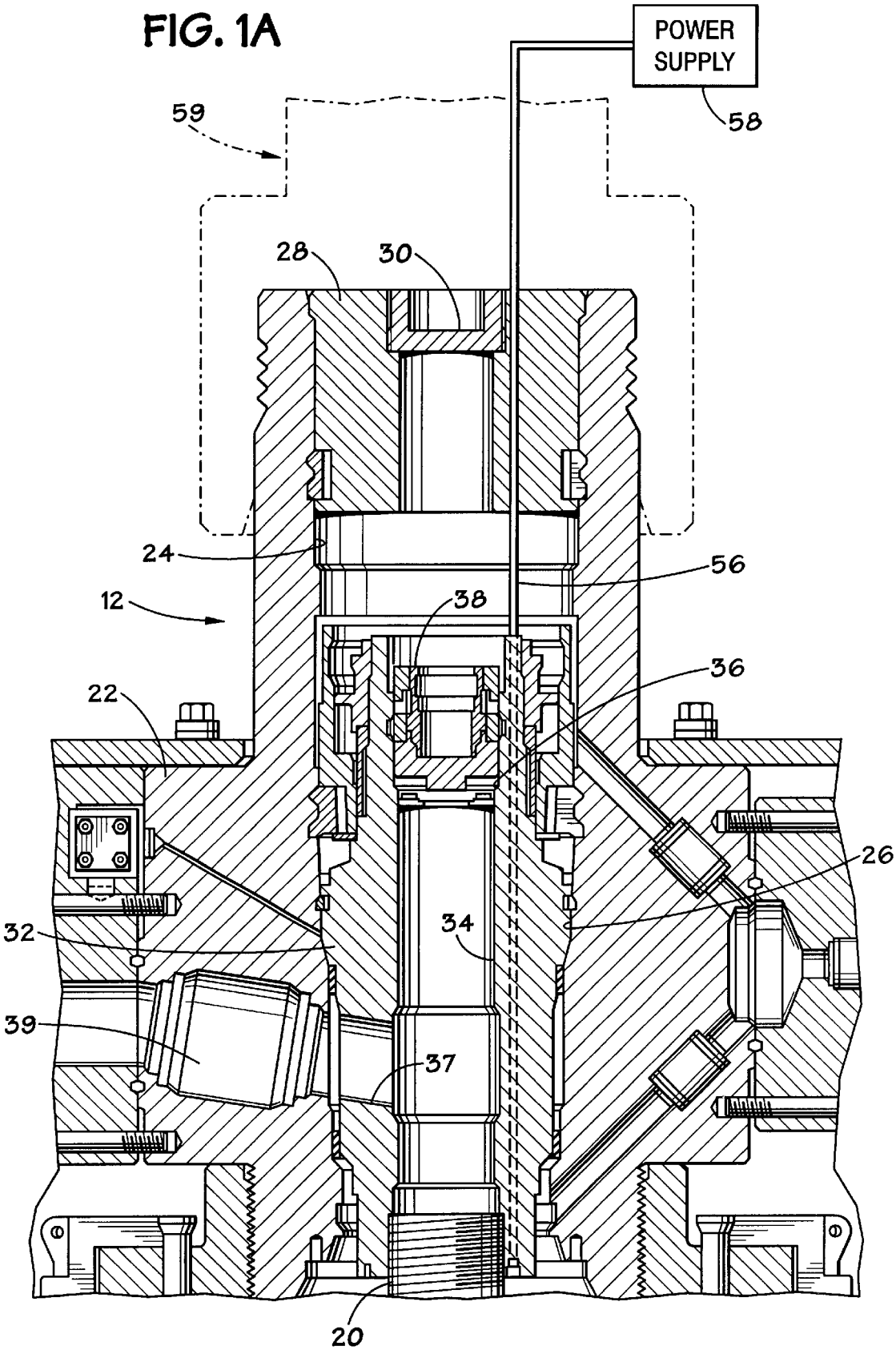
FIGS. 1A and 1B are vertical cross-sectional views illustrating an exemplary wellbore containing a Y-tool with two production tubing legs and configured for well production in stages one and two.
Figure 1B:
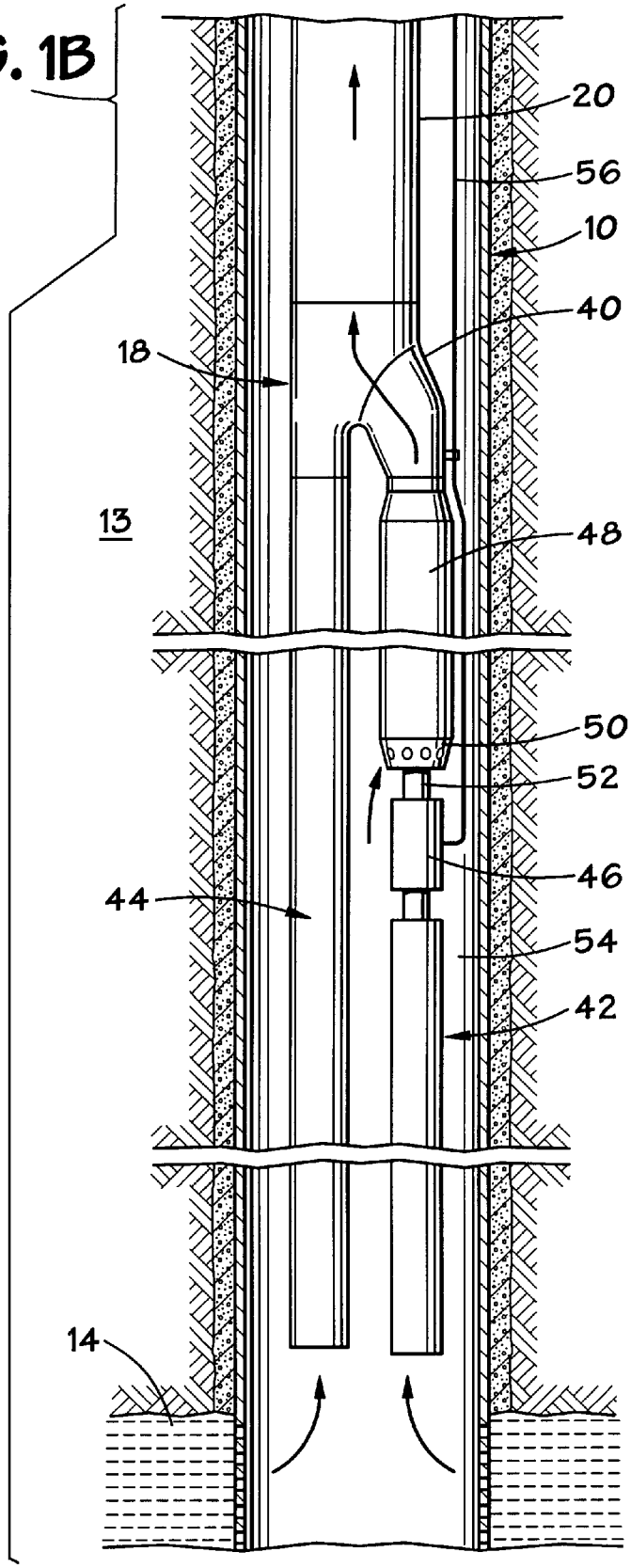

Referring to FIGS. 1A and 1B, there is shown a wellbore 10 that extends downward from a wellhead 12 through rock formations 13 to a hydrocarbon reservoir 14. The wellbore 10 has one or more strings of outer casing (not shown) that are cemented in the wellbore 10. The casing has perforations (not shown) near its lower end allowing flow of well fluid into the wellbore 10 from the earth reservoir 14. A production assembly 18 having a string of production tubing 20 is shown suspended in casing 16. Production tubing 20 is made up of a plurality of tubing sections that are secured together.

As FIG. 1A depicts, the wellhead 12 has a tree 22 that carries a number of valves and fluid passages, as is known in the art. Tree 22 is known as a "horizontal" tree and is commonly installed subsea. A longitudinal bore 24 is defined within the tree 22 and has presents a seating profile 26. The upper end of the tree 22 is sealed by a removable tree cap 28 that fits in bore 24. The tree cap 28 has a removable plug 30, the lower end of which is visible in FIG. 1A. While the cap 28 is shown to be of an internal type, fitting on the upper end of tree 22, it could also be of an external type fitting over the tree 22.

A production tubing hanger 32 is disposed within the tree 22 upon seating profile 26 and is used to suspend the production tubing 20 within the wellbore 10. The tubing hangar 32 defines a vertical passage 34 therethrough. The upper end of the passage 34 carries an annular landing shoulder 36. A removable crown plug 38 is shown seated in the landing shoulder 36. Tubing hanger 32 and tree 22 have mating lateral flow passages 37, 39 for the flow of production fluid.

FIG. 1B illustrates portions of the production assembly 18 within the well 10 below the wellhead. The production tubing 20 is bifurcated at its lower end. A Y-shaped splitter or Y-tool 40 is used to split the production tubing 20 into two separate and parallel legs, a pump leg 42 and a bypass leg 44. A suitable Y-shaped splitter component is the "Auto Y-Tool" which contains an internal spring-biased flapper valve 45 (see FIG. 2C) that selectively blocks fluid flow through one leg or the other. This component is available commercially from Phoenix Petroleum Services Limited. The bypass leg 44 is a straight member made up of interconnected sections and has an open lower end. The pump leg 42 supports a motor 46 and a pump 48, such as a conventional ESP, that is driven by the motor 46. The pump 48 is incorporated directly into the string of production tubing sections making up the pump leg 42. The fluid intake portion 50 of the pump 48 is shown to be upon the lower radial exterior of the pump 48. The motor 46 and pump 48 are typically separated by a seal section 52. Seal section 52 equalizes the pressure of lubricant within motor 46 with that of the tubing annulus 54. The motor 46 is normally a three-phase electrical motor. The pump 48 is typically a centrifugal pump, although it might also be a progressive cavity pump. The pump 48 is connected by a power cable 56 to a controller and power supply 58 at the surface (See FIG. 1 A). The power cable 56 is strapped along side the production tubing 20. At the wellhead 12, the power cable 56 is disposed through the tree 22 and tree cap 28 using wet-mate connectors 57 (FIG. 2A) of a type known in the art with tubing hanger 32. Wet mate connector 57 has connector pins that are driven laterally inward into engagement with contacts in the tubing hanger 32. The connector pins of connector 57 may be driven inward electrically or hydraulically.

When the pump 48 begins to operate, the valve 45 of the Y-tool 40 automatically flips over and seals off the bypass leg 44 due to the fluid pressure generated by the pump 48. When the pump 48 is not operating, a spring incorporated within valve 45 causes the flapper valve 45 within the splitter 40 to shift back to the position shown in FIG. 2C, blocking fluid flow through the pump leg 42.

The operation of the production assembly 18 during first two stages of production may be understood with reference to FIGS. 1A–1B. During initial production, preferably, hydrocarbons are produced from the well 10 using natural pressures from formation 14. During this first stage of production, even though already installed, the first pump 48 is not operated and production fluids flow into the production tubing 20 primarily through the bypass leg 44. The valve 45 of Y-tool 40 selectively closes off fluid flow through the pump leg 42. In some instances, first pump 48 will be operated initially to augment any natural production flow.

After production using natural formation pressures is no longer possible or economically feasible, the first pump 48 is actuated, to begin the second stage of production from the well 10. During this phase of production, the valve 45 of Y-tool 40 selectively closes off fluid flow through the bypass leg 44 in favor of production flow into the production tubing 20 through the pump leg 42.

Figure 2A:
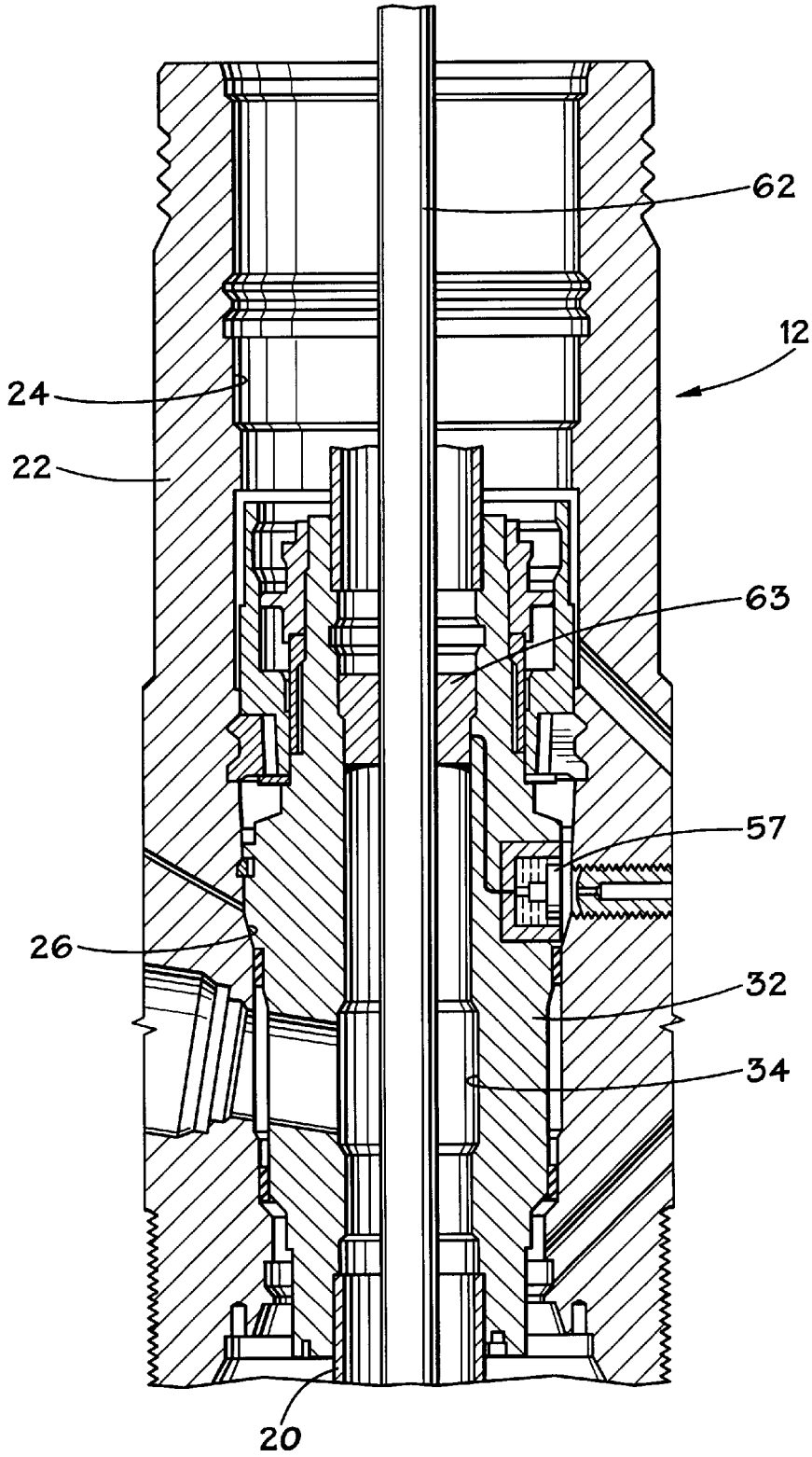

Referring now to FIGS. 2A–2C, the production assembly 18 of the present invention is shown in a configuration for production of additional hydrocarbons after natural production, if any, has ended and after the first pump 48 has failed or otherwise ceased operation. As FIG. 1A shows, a lightweight riser 59 is lowered from a floating vessel and connected to the upper end of the tree 22. Then the plug 30 is removed from the tree cap 28. The crown plug 38 is also removed from the landing profile 36 within the bore 34 of the tubing hanger 32. The plugs 30, 38 may be removed by a wireline tool.

A second pump 60 (FIG. 2B) is lowered through the riser 59, bore 34 and into the production tubing 20 on a string of coiled tubing 62. The coiled tubing 62 is disposed into the production tubing 20 using a coiled tubing rig on a surface vessel (not shown) in a manner known in the art. The coiled tubing 62 may also be hung from a coiled tubing hanger 63 that is landed inside the tubing hangar 32. The power cable for the second pump 60 is located with the coiled tubing 62. A second wet mate electrical connector (not shown), similar to the electrical connector 57, has pins that move laterally inward for engaging contacts in the coiled tubing hanger 63.

The second pump 60 is connected to the coiled tubing string 62 by a coiled tubing adapter of a type known in the art and may be equipped with a coiled tubing rapid disconnect of a type known for allowing rapid disconnection of the coiled tubing 62 from the second pump 60 in the event of an emergency.

As FIG. 2B shows, the second pump 60 is preferably located within the production tubing 20 to be above, but proximate, the Y-tool 40. However, it is noted that the second pump 60 may also be located anywhere within the production tubing, including near the surface, next to the Y-tool 40, or even within the bypass leg 44. A stub portion 65 of production tubing is affixed below the second pump 60 for intake of fluids.

During the third stage of production, the second pump 60 is operated to flow production fluids through the stub portion 65, pump 60 and production tubing 20 to the surface of the well 10. The Y-tool valve 45 will be in the position blocking leg 42 as it is biased into this position by a spring. The well fluid flows up an annulus surrounding coiled tubing 62 in production tubing 20. The pump 60 may be easily retrieved to the surface for maintenance or replacement by simply withdrawing the coiled tubing 62 from the well 10. Further, if the pump 60 fails, it maybe as easily retrieved and replaced.

Figure 3:
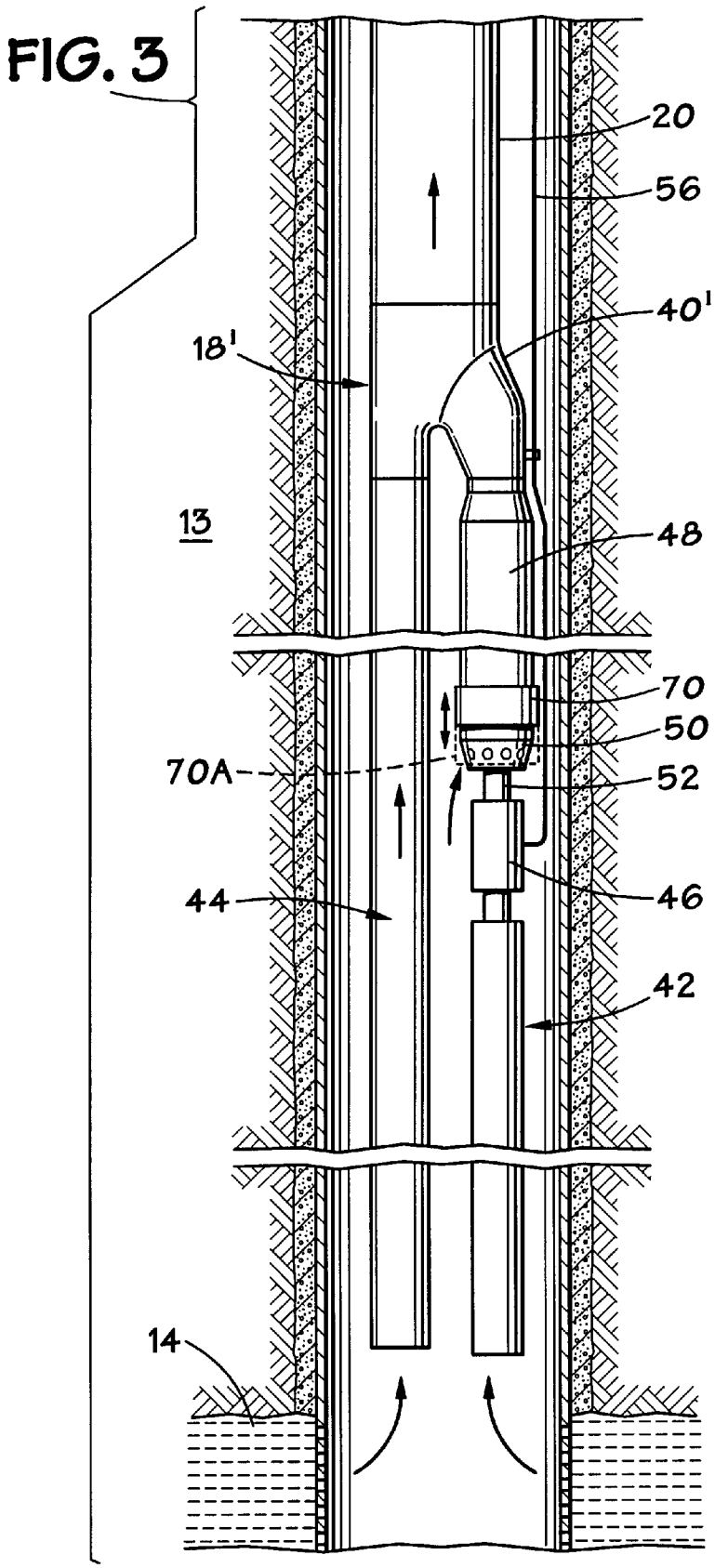
FIG. 3 depicts a first alternative embodiment of the invention wherein sliding sleeve assembly is used.

Referring now to FIG. 3, a downhole portion of an alternative embodiment of the invention is shown that has a slightly modified production assembly 18'. Like components between the various embodiments are numbered alike. The production assembly 18' incorporates a sliding sleeve arrangement rather than then valve 45 of the Y-tool 40 to selectively flow fluid through the pump leg 42 via pump 48. The production tubing 20 is bifurcated into two legs 42, 44 by a standard Y-type fitting 40', although the fitting 40' does not contain a flapper valve or other diverter means. A sliding sleeve 70 surrounds the a portion of the exterior of the pump 48 and may be axially moved upon the pump 48 to selectively cover the intake portion 50 of the pump 48. The position of the sleeve 70 designated by 70A depicts the sleeve 70 in such a closed position with the intake portion 50 covered. The sleeve 70 is moved between an opened and closed position by control from the surface. If necessary, control wiring for operation of the sleeve 70 may be incorporated into the power cable 56. The sleeve 70 is moved to the open position (to allow fluid to flow into the pump 48 through intake portion 50) when it is desired to flow production fluid through the pump leg 42. Conversely, the sleeve 70 is moved to the closed position (blocking fluid passage into the intake portion 50) when it is desired to not use the pump 48, such as when natural flow through the bypass leg 44 is occurring. Also, the sleeve 70 is closed after the pump 48 has failed and production is occurring using the supplemental coiled tubing-based pump 60.

Figure 4:
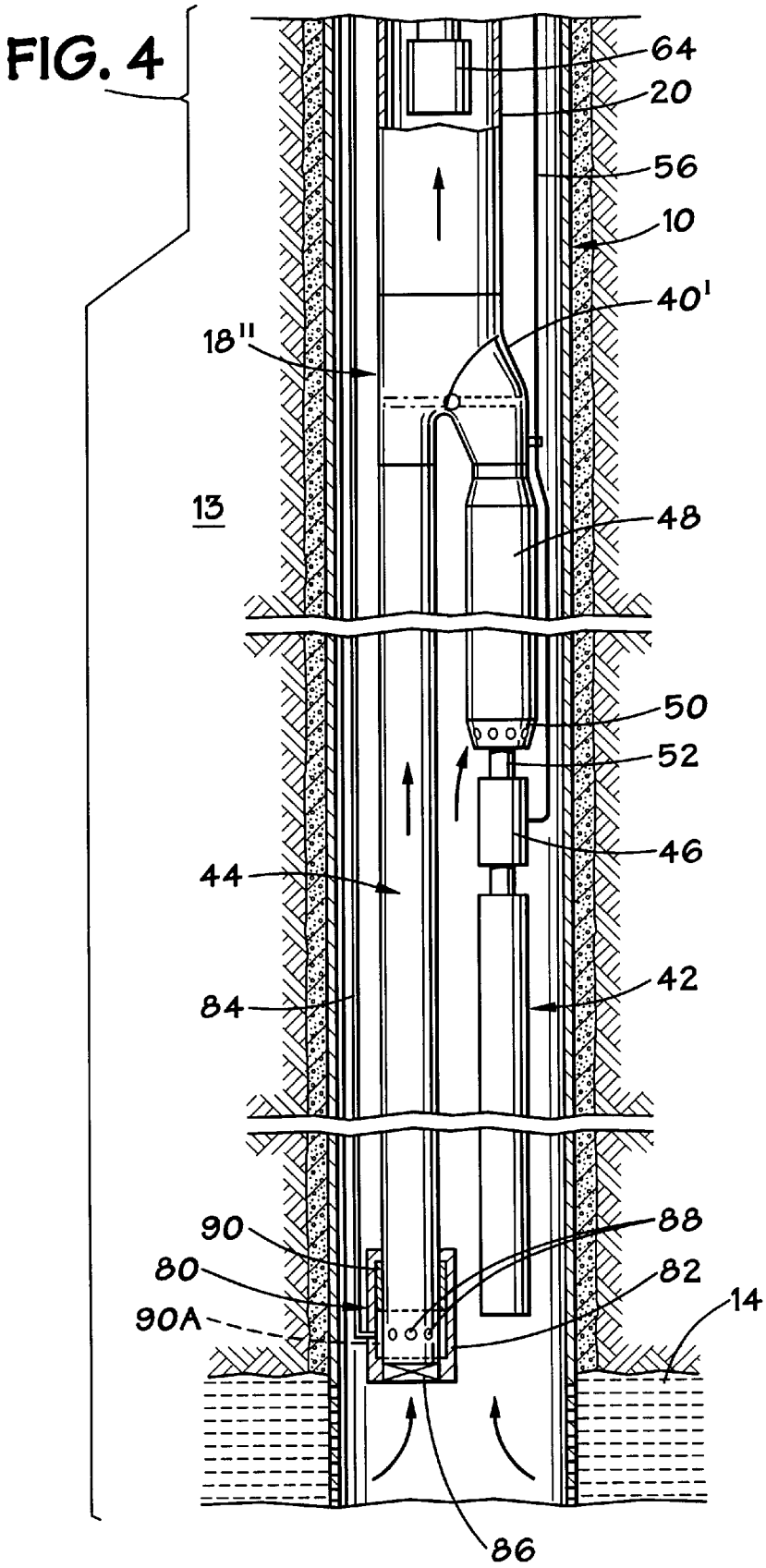
FIG. 4 illustrates a second alternative embodiment of the invention also incorporating a sliding sleeve.

FIG. 4 illustrates a second alternative embodiment 18" for a production assembly constructed in accordance with the present invention. The production assembly 18" is constructed and operates similar to the arrangement 18' in most respects. However, a sliding sleeve arrangement is provided at the lower end of the bypass leg 44 rather than the pump leg 42. An exemplary sliding sleeve assembly 80 is shown having an exterior shroud 82 that radially surrounds the lower end of the bypass leg 44. The sleeve assembly 80 is hydraulically operated, and hydraulic line 84 is shown extending downwardly from the surface to the assembly 80 for this purpose. The lower end of the bypass leg 44 contains a plug 86 that blocks fluid entry through the end of the leg 44. Perforations 88 are disposed through the leg 44. The shroud 82 encloses a sleeve 90 that is selectively moveable within the shroud 82 between an upper position (shown), wherein the perforations 88 are uncovered an permit fluid to flow into the interior of the bypass leg 44, and a lower position, depicted generally as 90A, wherein the perforations 88 are covered by the sleeve 90 to block entry of fluid through the perforations 88 and into the leg 44.

In operation, the sleeve assembly 80 is configured to have the sleeve 90 in the upper position during initial natural production so that production fluid will flow into the bypass leg 44 for movement to the surface of the well. During the second stage of production, when the first pump 48 is operated to assist production of well fluid, the sleeve assembly 80 is actuated to move the sleeve 90 to its lower position blocking the perforations 88 as well fluid is drawn through the pump leg 42. During the third stage of production, when coiled tubing based pump 64 is lowered into the production string 20, the sleeve assembly 80 is actuated to return the sleeve 90 to its upper position and allow well fluid to enter the bypass leg 44.

Figure 5:
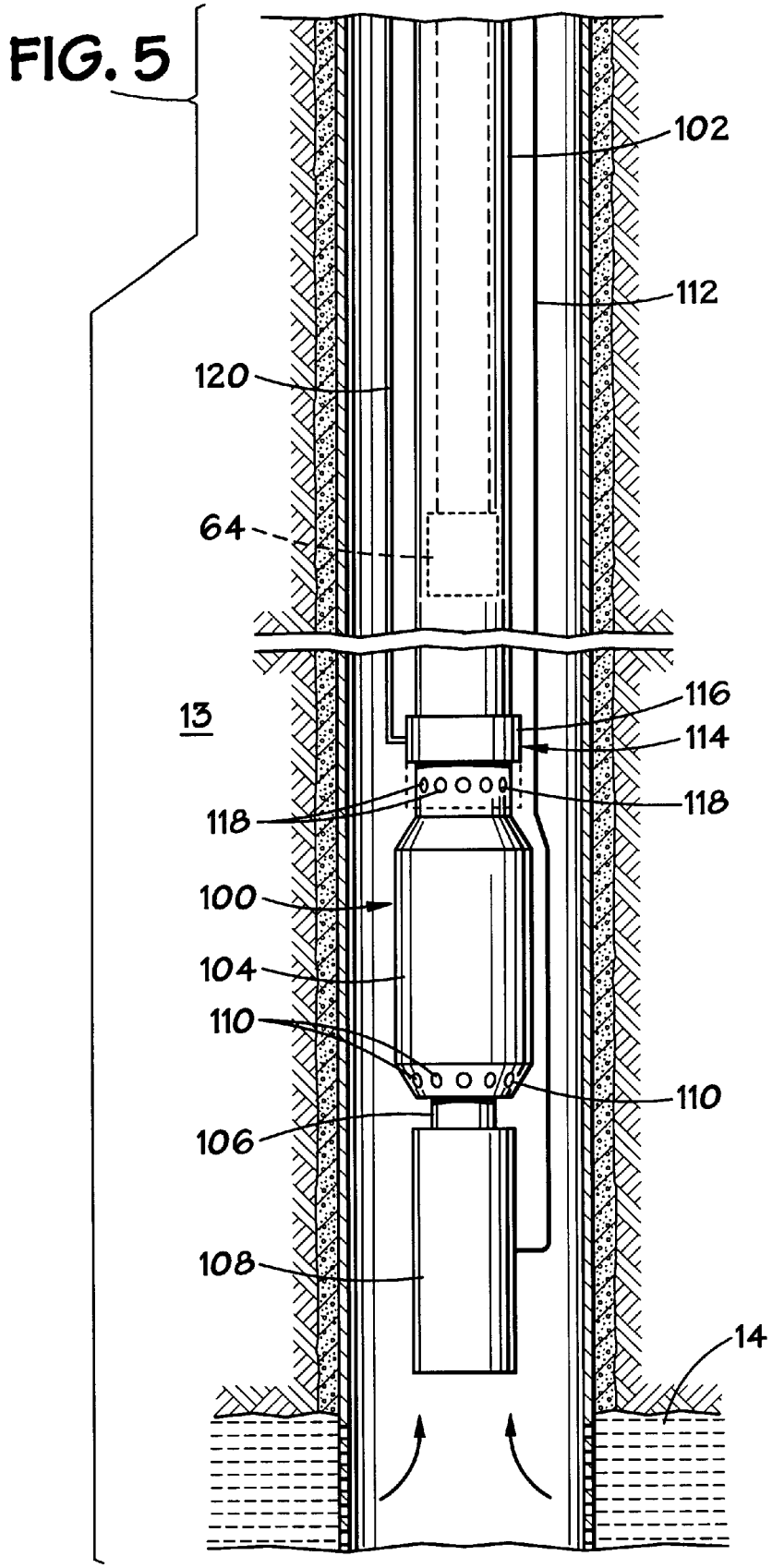
FIG. 5 shows a third alternative embodiment of the invention incorporating sliding sleeve.

Referring now to FIG. 5, a third alternative production assembly 100 is depicted that utilizes a sliding sleeve assembly with a non-bifurcated production tubing assembly. The assembly has production tubing 102. At the lower end of the tubing 102 is affixed a pump 104, which is similar in construction and operation to the first pump 48 described earlier. The pump 104 is connected by a seal 106 to a motor 108 that drives the pump 104. The pump 104 includes fluid openings 110 at its lower end through which production fluid is drawn into the pump 104. A power cable 112 is shown in connection with the motor 108.

Located above the pump 104 on the production tubing 102 is a sliding sleeve assembly 114 that includes an annular sleeve 116. The sleeve 116 radially surrounds the production tubing 102. The assembly 114 also includes a number of fluid communication perforations 118 within the tubing 102. The sleeve 116 is moveable upwardly and downwardly upon the tubing 102 to selectively cover the perforations 118 thereby blocking entrance of production fluid through them. The sleeve 116 is operable using a hydraulic cable 120.

In operation, the sleeve 116 of the sleeve assembly 114 is in the upward position during initial natural production. As a result, production fluid is able to enter the tubing 102 through the perforations 118. During the second stage of production, the sleeve 116 is moved to the downward position blocking fluid flow through the perforations 118. The pump 104 is actuated and draws production fluid into the pump 104 and tubing 102 through the fluid openings 110. When the pump 104 fails, second pump 64 (shown in phantom) is lowered into the production tubing 102. The sleeve 116 is moved to the upward position to permit production fluid to once again enter the tubing 102 s the second pump 64 is actuated to flow it.

While the invention has been shown in only one of its forms, it should be apparent to those skilled in the art that it is not so limited, but is susceptible to various changes without departing from the scope of the invention.

What is claimed is:

1. A method of producing hydrocarbons from a well, comprising:

a) disposing a first pump within a wellbore, the first pump being suspended on production tubing in the well;

b) actuating the first pump to flow well fluid through the production tubing;

c) lowering a second pump into the production tubing and communicating an intake of the second pump with the well fluid; and d) after ceasing to operate the first pump, actuating the second pump to flow additional hydrocarbons from the well.

2. The method according to claim 1 wherein disposing the second pump within the production tubing comprises running the second pump into the production tubing on coiled tubing.

3. The method of claim 1 wherein the second pump pumps well fluid through the production tubing.

4. The method of claim 3 wherein the production tubing is bifurcated by incorporating a y-tool having first and second legs within the production tubing, wherein the first pump draws well fluid through the first leg and the second pump draws well fluid through the second leg.

5. The method of claim 4 wherein the operation of actuating the first pump further comprises selectively blocking flow through the second leg.

6. The method of claim 5 wherein the first pump is actuated by supplying electrical power through a first power cable to the first pump and the second pump is actuated by supplying electrical power though a second power cable to the second pump.

7. The method of claim 1 further comprising flowing well fluid through the production tubing under natural formation pressures, after installing the first pump and prior to actuating the first pump.

8. A production assembly for use in production of well fluid from a well, comprising:

a) a production tubing string;

b) a first fluid pump incorporated into the production tubing string to produce fluid from the well; and c) a second fluid pump that is selectively disposable within the production tubing to assist production of fluid from the well.

9. The production assembly of claim 8 wherein the production tubing string is bifurcated to provide a pair of legs.

10. The production assembly of claim 9 wherein the production tubing string is bifurcated using a Y-fitting having a flapper valve for selective isolation of flow between the legs.

11. The production assembly of claim 8 wherein the second fluid pump comprises a coiled tubing-based pump.

12. The production assembly of claim 11 wherein the second fluid pump further comprises an electric submersible pump.

13. The production assembly of claim 8 further comprising a sliding sleeve assembly incorporated into the production tubing string to selectively open perforations in the tubing string and permit entry of production fluid into the tubing string.

14. The production assembly of claim 13 wherein the sliding sleeve assembly is hydraulically actuated.

* * * * *

UNITED STATES PATENT AND TRADEMARK OFFICE

CERTIFICATE OF CORRECTION

PATENT NO. : 6,508,308 B1 
DATED : September 26, 2000
INVENTOR(S) : Christopher Kempson Shaw It is certified that error appears in the above-identified patent and that said Letters Patent is hereby corrected as shown below:

Column 2,
Line 28, after "incorporating" insert -- a --
Line 47, delete "has" before "presents"

Column 4,
Line 41, after "than" delete "then"

Column 5,
Line 13, after "uncovered" delete "an" and insert -- and --

Signed and Sealed this

First Day of July, 2003

JAMES E. ROGAN
*Director of the United States Patent and Trademark Office*